US008384731B2

(12) United States Patent
Hsieh et al.

(10) Patent No.: US 8,384,731 B2
(45) Date of Patent: Feb. 26, 2013

(54) COLOR TRANSFORMATION METHOD AND CORRESPONDING COLOR DISPLAY METHOD

(75) Inventors: Pei-Lin Hsieh, Taipei County (TW); Yu-Ju Lee, Taoyuan County (TW); Hsiang-Tan Lin, Keelung (TW)

(73) Assignee: Chunghwa Picture Tubes, Ltd., Bade, Taoyuan (TW)

( * ) Notice: Subject to any disclaimer, the term of this patent is extended or adjusted under 35 U.S.C. 154(b) by 824 days.

(21) Appl. No.: 12/535,700

(22) Filed: Aug. 5, 2009

(65) Prior Publication Data

US 2010/0289814 A1 Nov. 18, 2010

(30) Foreign Application Priority Data

May 13, 2009 (TW) ..... 98115817 A

(51) Int. Cl.
*G09G 5/02* (2006.01)

(52) U.S. Cl. ..... 345/589; 345/602

(58) Field of Classification Search ..... 345/589–605
See application file for complete search history.

(56) References Cited

U.S. PATENT DOCUMENTS

| | | | | |
|---|---|---|---|---|
| 5,333,243 | A * | 7/1994 | Best et al. | 358/1.9 |
| 6,058,207 | A * | 5/2000 | Tuijn et al. | 382/162 |
| 6,504,551 | B1 * | 1/2003 | Takashima et al. | 345/649 |
| 6,873,339 | B2 | 3/2005 | Ohsawa | |
| 7,092,122 | B2 * | 8/2006 | Iwaki | 358/1.9 |
| 7,268,757 | B2 | 9/2007 | Ben-David | |
| 2008/0043268 | A1 * | 2/2008 | Bang et al. | 358/1.9 |
| 2008/0150882 | A1 * | 6/2008 | Langendijk et al. | 345/102 |
| 2009/0167955 | A1 * | 7/2009 | Pettitt et al. | 348/649 |

* cited by examiner

*Primary Examiner* — Xiao M. Wu
*Assistant Examiner* — Charles Tseng
(74) *Attorney, Agent, or Firm* — Winston Hsu; Scott Margo

(57) ABSTRACT

A color transformation method includes following steps. First, a color signal is received. Then, a saturation calculation step is performed to generate a saturation value of the color signal, and a hue-angle-weighting calculation step is performed to generate a first hue-angle weighting of the color signal corresponding to a first LUT and a second hue-angle weighting of the color signal corresponding to a second LUT. Next, a color calculation step is performed to transform the color signal into a first color output signal according to the saturation value and the first hue-angle weighting and to transform the color signal to a second color output signal according to the saturation value and the second hue-angle weighting.

11 Claims, 14 Drawing Sheets

| Condition | Hue angle H(×60) | Hue angle H(×64) |
|---|---|---|
| Red gray value≧ Green gray value≧ Blue gray value | H=0+60×((Green gray value−Blue gray value)/(Red gray value−Blue gray value) | H=0+60×((Green gray value−Blue gray value)/(Red gray value−Blue gray value) |
| Green gray value> Red gray value≧ Blue gray value | H=60+60×((Red gray value−Blue gray value)/(Green gray value−Blue gray value) | H=64+64×((Red gray value−Blue gray value)/(Green gray value−Blue gray value) |
| Green gray value≧ Blue gray value> Red gray value | H=120+60×((Blue gray value−Red gray value)/(Green gray value−Red gray value) | H=128+64×((Blue gray value−Red gray value)/(Green gray value−Red gray value) |
| Blue gray value> Green gray value≧ Red gray value | H=180+60×((Green gray value−Red gray value)/(Blue gray value−Red gray value) | H=192+64×((Green gray value−Red gray value)/(Blue gray value−Red gray value) |
| Blue gray value> Red gray value≧ Green gray value | H=240+60×((Red gray value−Green gray value)/(Blue gray value−Green gray value) | H=256+64×((Red gray value−Green gray value)/(Blue gray value−Green gray value) |
| Red gray value≧ Blue gray value> Green gray value | H=300+60×((Blue gray value−Green gray value)/(Red gray value−Green gray value) | H=320+64×((Blue gray value−Green gray value)/(Red gray value−Green gray value) |

FIG. 9

COLOR TRANSFORMATION METHOD AND CORRESPONDING COLOR DISPLAY METHOD

BACKGROUND OF THE INVENTION

1. Field of the Invention

The present invention relates to a color transformation method and a corresponding color display method, and more particularly, to a color transformation method and a corresponding color display method used by a display device with two backlights so as to raise a color gamut.

2. Description of the Prior Art

Traditional displays mix three primary colors of red, green and blue in a single pixel to display a required color, and a required image can be displayed by combining a plurality of pixels displaying different colors. Because the displayed color in the pixel is mixed by the three primary colors which are predetermined by the display, the displayed color is limited to a color gamut which is composed of the three primary colors, so that the display can not display a correct color of an image.

The prior art methods for raising the color gamut can be divided into two kinds, which respectively are a color mixing method in space and a color sequential method. The methods of the prior art mainly use increasing the number of the mixed color to achieve mixing multiple primary colors, so that the color gamut can be raised. Please refer to FIG. 1, which is a schematic diagram illustrating a color mixing method in space according to the prior art. As shown in FIG. 1, the color mixing method in space further provides a yellow color filter Y, a magenta color filter M and a cyan color filter C besides a red color filter R, a green color filter G and a blue color filter B. For this reason, a single pixel can have six primary colors to perform mixing color so as to raise the color gamut for color display.

In addition, a color sequential method utilizes a color transformation matrix to transform three inputted primary-color signals from gray-level signals into XYZ color-space signals. Then, a multiple primary-color algorithm is performed to transform the XYZ color-space signals into four primary-color signals C1, C2, C3 and C4. Finally, the primary-color signals C1, C2 are projected by a first projecting device, and the primary-color signals C3, C4 are projected by a second projecting device, so that the primary-color signals C1, C2, C3 and C4 can be mixed to raise the displayed color gamut.

However, according to the above-mentioned description, the color mixing method in space of the prior art is required to increase color filters with different colors in each pixel, so that extra processes should be performed to manufacture the increased color filters with different colors. The manufacture cost is therefore increased. Furthermore, the color sequential method of the prior art is required to use the color transformation matrix to transform three primary-color signals from the gray-level signals into the XYZ color-space signals, so that a plurality of multipliers and adders should be required. For this reason, the complexity of circuit devices and the number of devices are increased, and manufacturing the circuit devices is not easy. Therefore, to raise the color gamut and to simplify the circuit devices and the complexity of manufacturing process is an objective that industry aims to achieve.

SUMMARY OF THE INVENTION

It is therefore a primary objective to provide a color transformation method and a corresponding color display method to raise color gamut.

According to a preferred embodiment, a color transformation method is disclosed. First, a color signal is received. Then, a saturation calculation step is performed to generate a saturation value of the color signal through a saturation calculator, and a hue-angle-weighting calculation step is performed to generate a first hue-angle weighting of the color signal corresponding to a first look-up table (LUT) and a second hue-angle weighting of the color signal corresponding to a second LUT. Next, a color calculation step is performed to transform the color signal into a first color output signal according to the saturation value and the first hue-angle weighting, and to transform the color signal to a second color output signal according to the saturation value and the second hue-angle weighting through a color calculator.

According to a preferred embodiment, a color display method is disclosed. First, the color signal is transformed into the first color output signal and the second color output signal by a calculator according to the color transformation method of the present invention. Next, the first color output signal and the second color output signal is outputted to a display device in sequence, wherein the display device comprises a first backlight and a second backlight. Then, the first color output signal is displayed, and the first backlight is simultaneously turned on. Finally, the second color output signal is displayed, and the second backlight is simultaneously turned on.

As the above-mentioned description, the color transformation method of the present invention calculates the saturation value and two hue-angle weightings of the color signal, and then, performs the color calculation step corresponding to two backlights so as to generate two different color output signals. Furthermore, in cooperation with sequentially turning on the backlights, more colorful images can be displayed, and the color gamut can be raised.

These and other objectives of the present invention will no doubt become obvious to those of ordinary skill in the art after reading the following detailed description of the preferred embodiment that is illustrated in the various figures and drawings.

BRIEF DESCRIPTION OF THE DRAWINGS

FIG. 9 is a list of the hue-angle calculation formula of the present invention.

DETAILED DESCRIPTION

Figure 1:
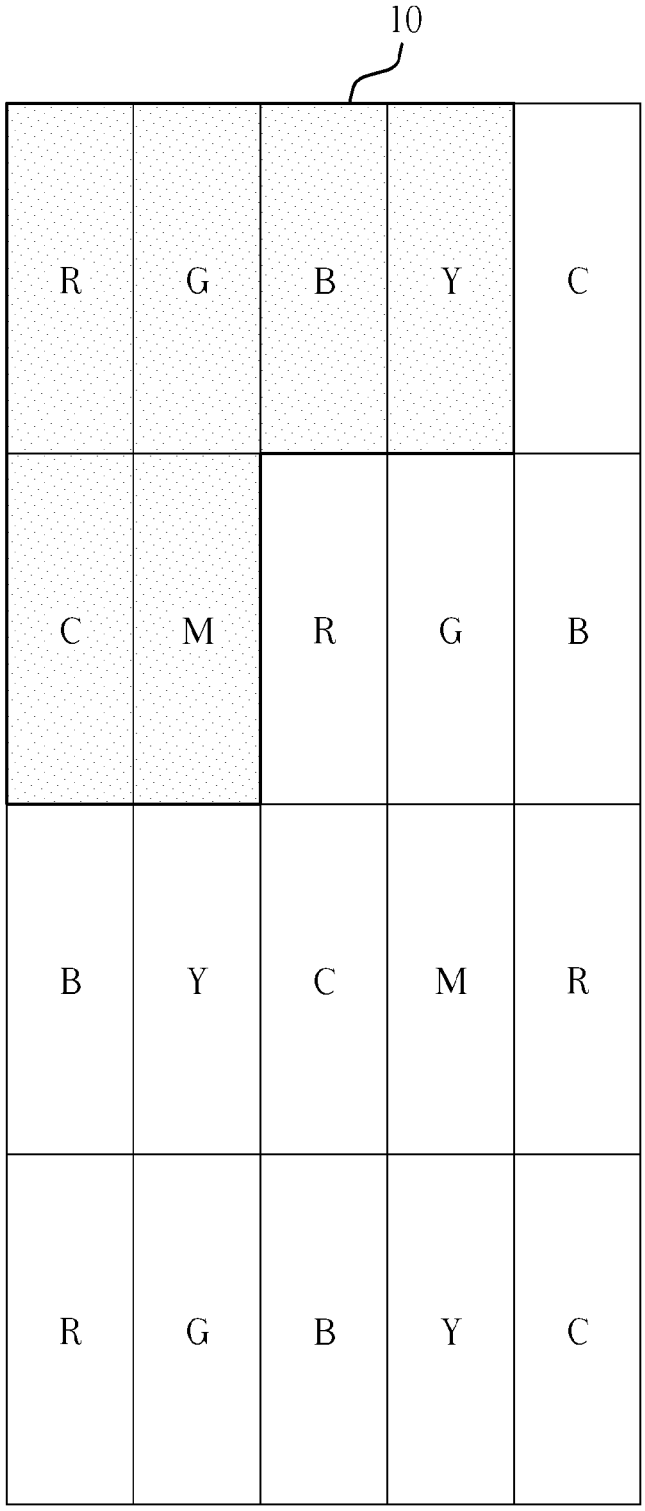
FIG. 1 PRIOR ART
FIG. 1 is a schematic diagram illustrating a color mixing method in space according to the prior art.
Figure 2:
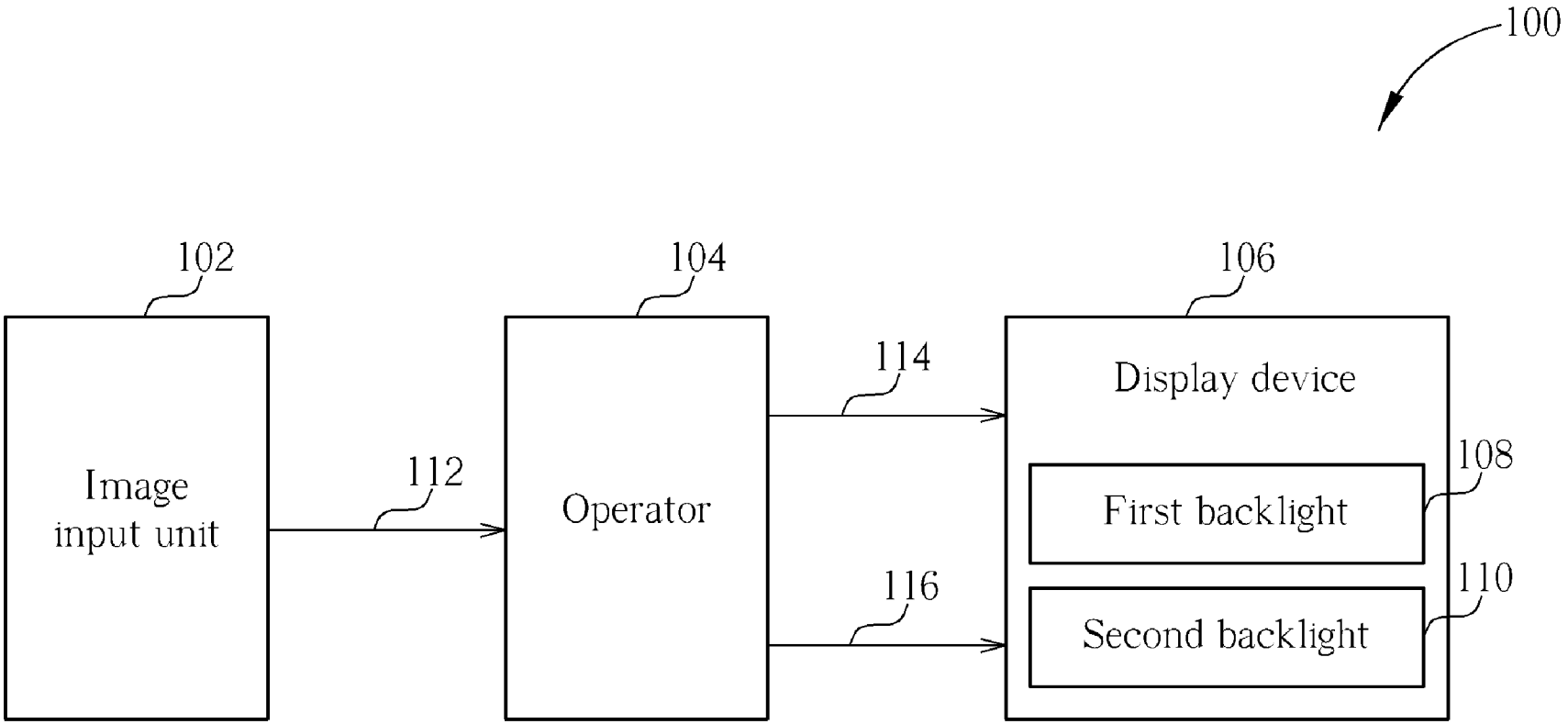
FIG. 2 is a functional block diagram illustrating a color display system of the present invention.
Figure 3:
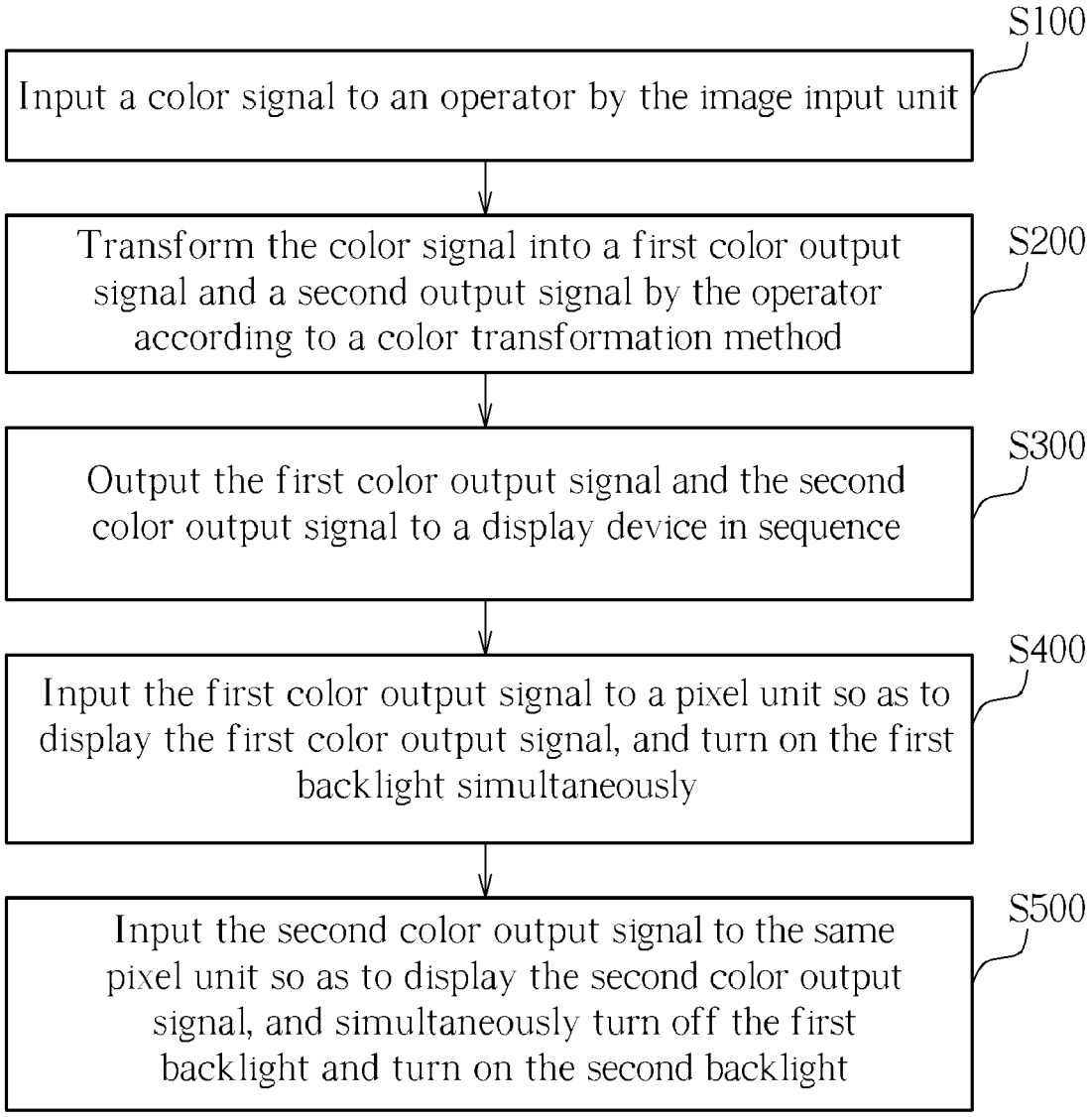
FIG. 3 is a flow chart illustrating a color display method of the present invention.

Please refer to FIG. 2 and FIG. 3. FIG. 2 is a functional block diagram illustrating a color display system of the present invention. FIG. 3 is a flow chart illustrating a color display method of the present invention. As shown in FIG. 2, the color display system 100 of the present invention includes an image input unit 102, a calculator 104 and a display device 106. The display device 106 includes a plurality of pixel units (not shown in figure), a first backlight 108 and a second backlight 110. As shown in FIG. 3, the color display method of the present invention includes the following steps:

Step S100: input a color signal 112 to a calculator 104 by the image input unit 102;

Step S200: transform the color signal 112 into a first color output signal 114 and a second output signal 116 by the calculator 104 according to a color transformation method;

Step S300: output the first color output signal 114 and the second color output signal 116 to the display device 106 in sequence;

Step S400: input the first color output signal 114 to a pixel unit so as to display the first color output signal 114, and turn on the first backlight simultaneously; and Step S500: input the second color output signal 116 to the same pixel unit so as to display the second color output signal 116, and simultaneously turn off the first backlight 108 and turn on the second backlight 110.

Figure 4:
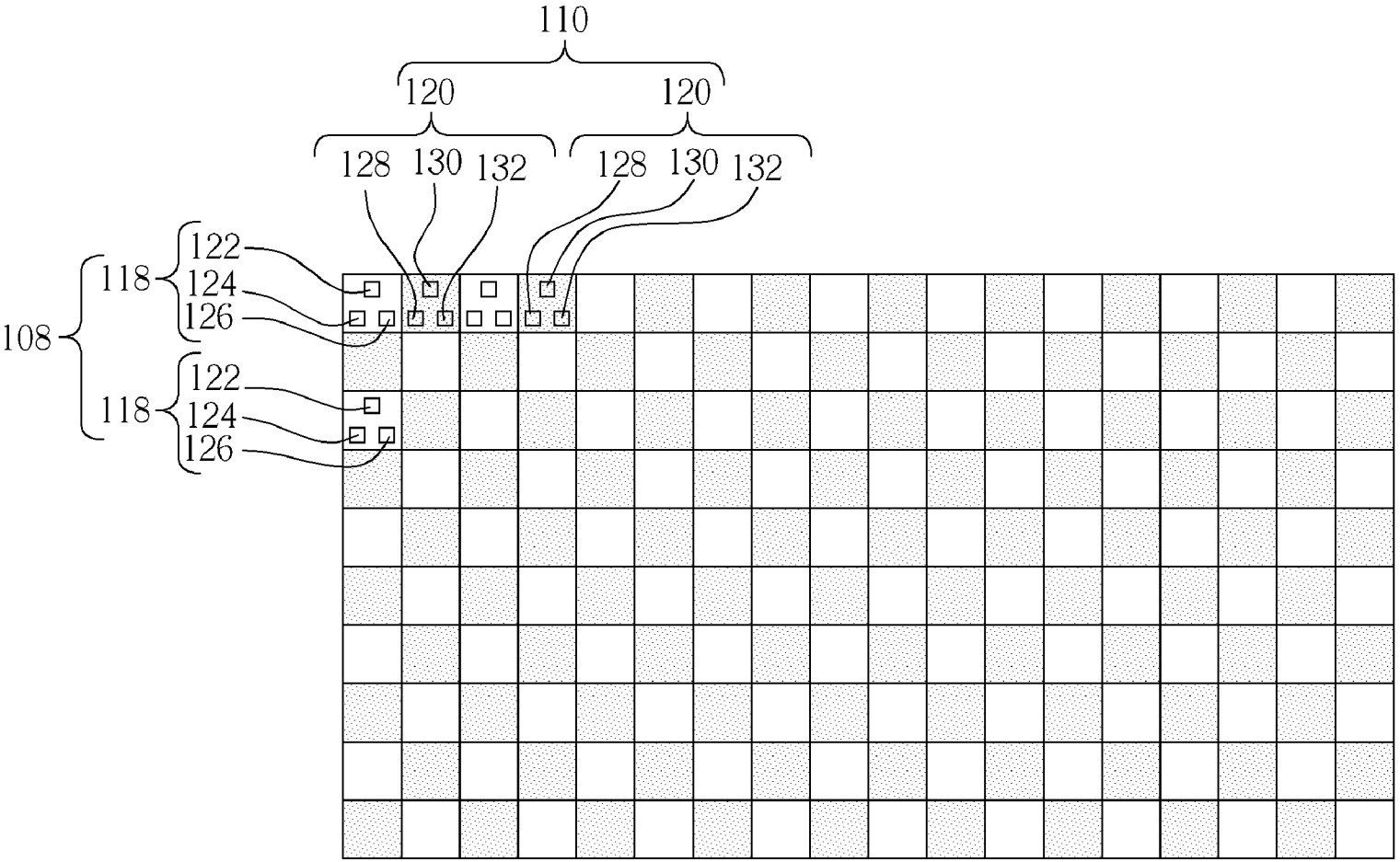
FIG. 4 is a schematic diagram illustrating a distribution of the first backlight and the second backlight of the present invention.

In addition, please refer to FIG. 4, which is a schematic diagram illustrating a distribution of the first backlight and the second backlight of the present invention. As shown in FIG. 4, the first backlight 108 includes a plurality of first light-emitting units 118 with a first gamut and a plurality of second light-emitting units 120 with a second gamut. The first light-emitting units 118 and the second light-emitting units 120 disposed in a same row are arranged alternately, and the first light-emitting units 118 and the second light-emitting units 120 disposed in a same column are also arranged alternately. Each first light-emitting unit 118 of the present invention includes a first color light-emitting diode (LED) 122, a second color LED 124 and a third color LED 126, and each second light-emitting unit 120 includes a fourth color LED 128, a fifth color LED 130 and a sixth color LED 132. The light-emitting unit of the present invention is not limited to be composed of the LEDs, and can be composed of other light-emitting devices. This embodiment takes the first light-emitting unit 118 including a first red LED 122, a first green LED 124 and a first blue LED 126 and the second light-emitting unit 120 including a second red LED 128, a second LED 130 and a blue LED 134 as an example, but is not limited to this. In addition, the wavelength of the first red LED 122 and the wavelength of the second red LED 128 are 620.59 nm. The wavelength of the first green LED 124 is 531 nm, and the wavelength of the second green LED 130 is 506 nm. The wavelength of the first blue LED 126 is 459 nm, and the wavelength of the second blue LED 132 is 466 nm. The wavelengths of the first LEDs and the second LEDs are not limited to the above-mentioned wavelengths, and the present invention can use the first LEDs and the second LEDs with other different wavelengths according to the real requirements. Furthermore, the first backlight 108 and the second backlight 110 of this embodiment are composed of a 10×18 matrix, and the matrix is composed of the first light-emitting units 118 and the second light-emitting units 120. The present invention is not limited to this, and the size of the matrix composed of the first light-emitting units 118 and the second light-emitting units 120 can be adjusted or determined according to the real requirements.

Figure 5:
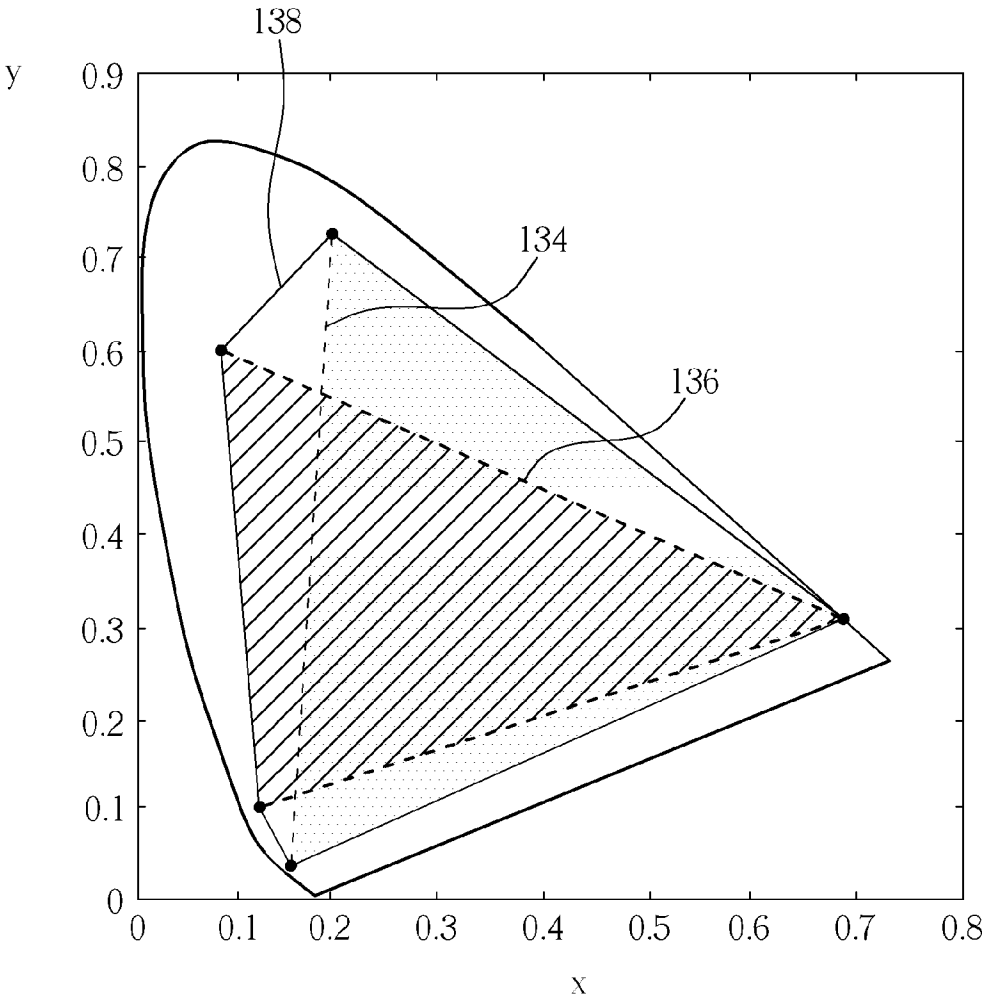
FIG. 5 is a CIE 1931 xy chromaticity diagram illustrating the first color gamut and the second color gamut of the present invention.

Please refer to FIG. 5, and refer to FIG. 4 together. FIG. 5 is a CIE 1931 xy chromaticity diagram illustrating the first color gamut and the second color gamut of the present invention. As shown in FIG. 5, the wavelength of the first red LED 122, the wavelength of the first green LED 124 and the wavelength of the first blue LED 126 can be mixed to form a first color gamut 134, and the wavelength of the second red LED 128, the wavelength of the second green LED 130 and the wavelength of the second blue LED 132 can be mixed to form a second color gamut 136. In addition, the present invention uses sequentially turning on the first backlight 108 and the second backlight 110 to mix the first color gamut 134 and the second color gamut 136. Furthermore, a hybrid color gamut 138 larger than the first color gamut 134 and the second color gamut 136 is therefore formed through the concept of color sequential method, so that the displayed color gamut can be raised.

Figure 6:
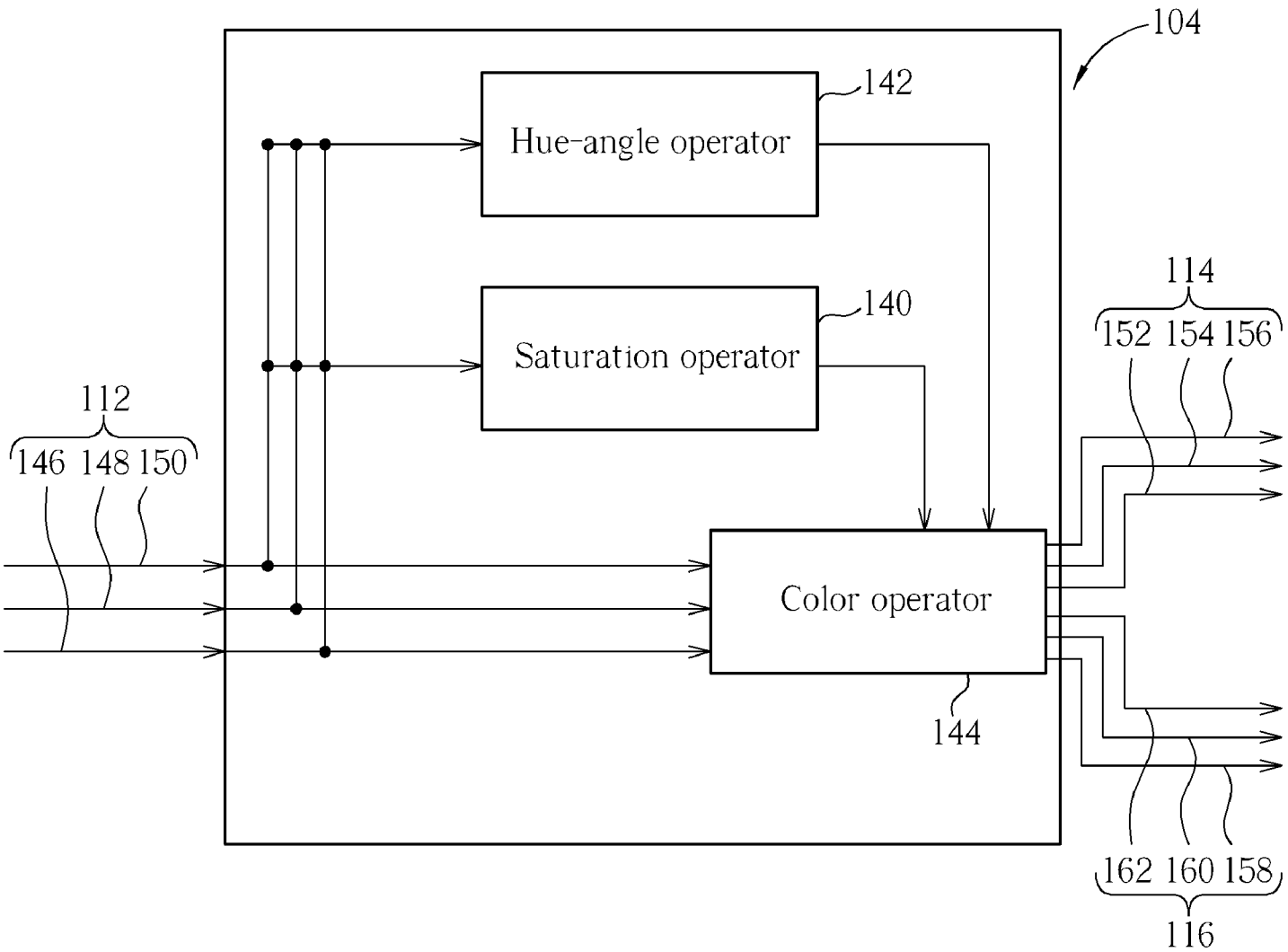
FIG. 6 is a block diagram illustrating a calculator according to the first embodiment of the present invention.
Figure 7:
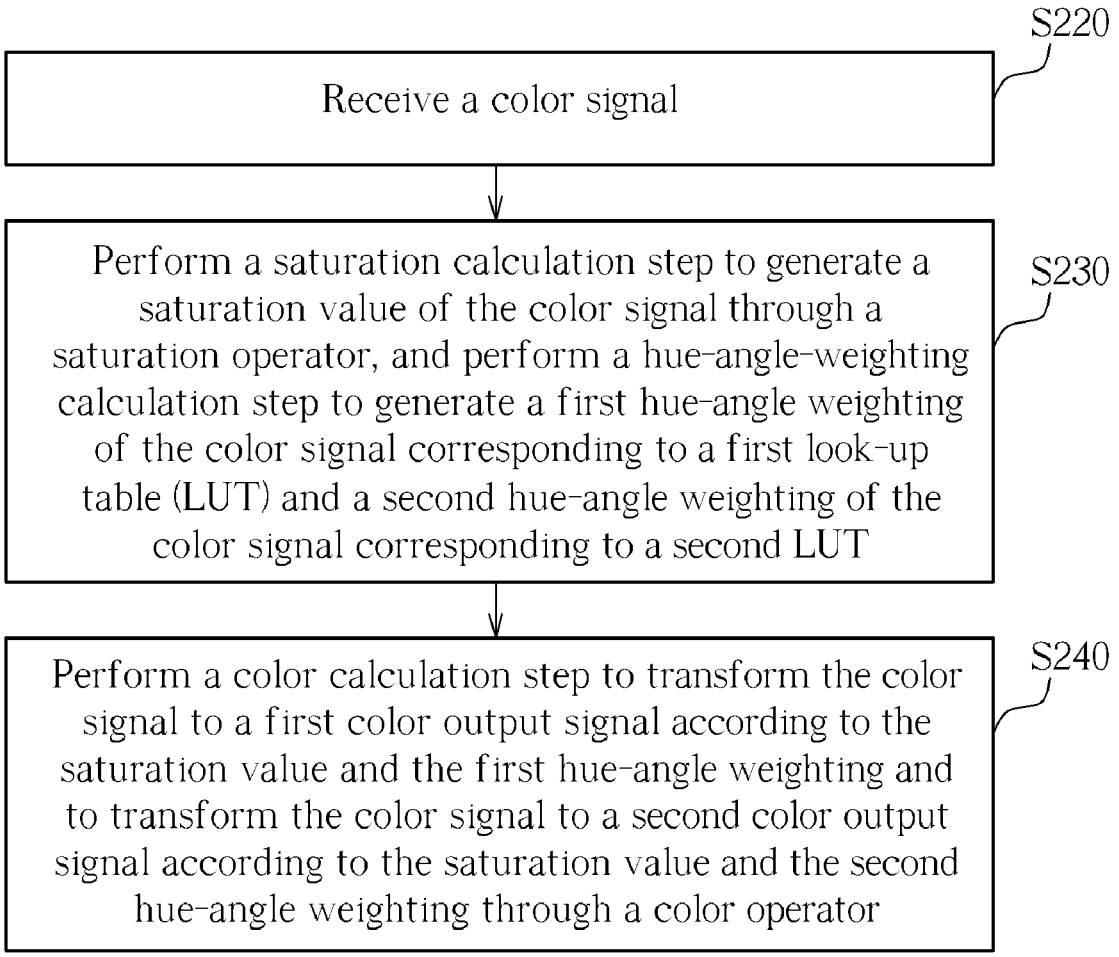
FIG. 7 is a flow chart illustrating the color transformation method according to the first embodiment of the present invention.

In order to cooperate with the step of sequentially turning on the first backlight 108 and the second backlight 110 so as to display the color in the hybrid color gamut, the color transformation method of the present invention will be detailed in the following description. Please refer to FIG. 6 and FIG. 7. FIG. 6 is a block diagram illustrating a calculator according to the first embodiment of the present invention. FIG. 7 is a flow chart illustrating the color transformation method according to the first embodiment of the present invention. As shown in FIG. 6, the calculator 104 includes a saturation calculator 140 a hue-angle calculator 142 and a color calculator 144. The saturation calculator 140, the hue-angle calculator 142 and the color calculator 144 can be composed of at least one adder, at least one subtractor, at least one multiplier or at least one divisor so as to calculate in adding, subtracting, multiplying or dividing operation for the inputted color signal 112. As shown in FIG. 7, the color transformation method of this embodiment includes the following steps Step S220: receive a color signal 112;

Step S230: perform a saturation calculation step to generate a saturation value of the color signal through a saturation calculator, and perform a hue-angle-weighting calculation step to generate a first hue-angle weighting of the color signal corresponding to a first look-up table (LUT) and a second hue-angle weighting of the color signal corresponding to a second LUT; and Step S240: perform a color calculation step to transform the color signal to a first color output signal according to the saturation value and the first hue-angle weighting and to transform the color signal to a second color output signal according to the saturation value and the second hue-angle weighting through a color calculator.

In step S220, the received color signal 112 of this embodiment includes a first primary color gray value 146, a second primary color gray value 148 and a third primary color gray value 150. In this embodiment, the first primary color gray value 146, the second primary color gray value 148 and the third primary color gray value 150 are respectively a red gray value 146, a green gray value 148 and a blue gray value 150, but are not limited to these. The colors of the first primary color gray value 146, the second primary color gray value 148 and the third primary color gray value 150 also can be other colors. For example, the colors of the first primary color gray value, the second primary color gray value and the third primary color gray value are respectively yellow, magenta and cyan.

In step S230, the saturation calculation step is performed according to a saturation calculation formula w=1−min/max, and the saturation value of the color signal 112 is generated by the saturation calculator 140, wherein w is the saturation value; min is a minimum among the red gray value 146, the green gray value 148 and the blue gray value 150; and max is a maximum among the red gray value 146, the green gray value 148 and the blue gray value 150. For example, a combination of the inputted red gray value 146, the inputted green gray value 148 and the inputted gray value 150 are respectively (255, 0, 0). The maximum is the red gray value 146, and is 255. The minimum is the green gray value 148 or the blue gray value 150, and is 0. Therefore, the saturation value w can be calculated to be 1. In another example, a combination of the inputted red gray value 146, the inputted green gray value 148 and the inputted gray value 150 are respectively (255, 253, 200). The maximum is the red gray value 146, and is 255. The minimum is the blue gray value 150, and is 200. Therefore, the saturation value w can be calculated to be 0.2157. The saturation calculation formula of the present invention is not limited to the above-mentioned formula, and can be adjusted according to the real requirements.

Figure 8:
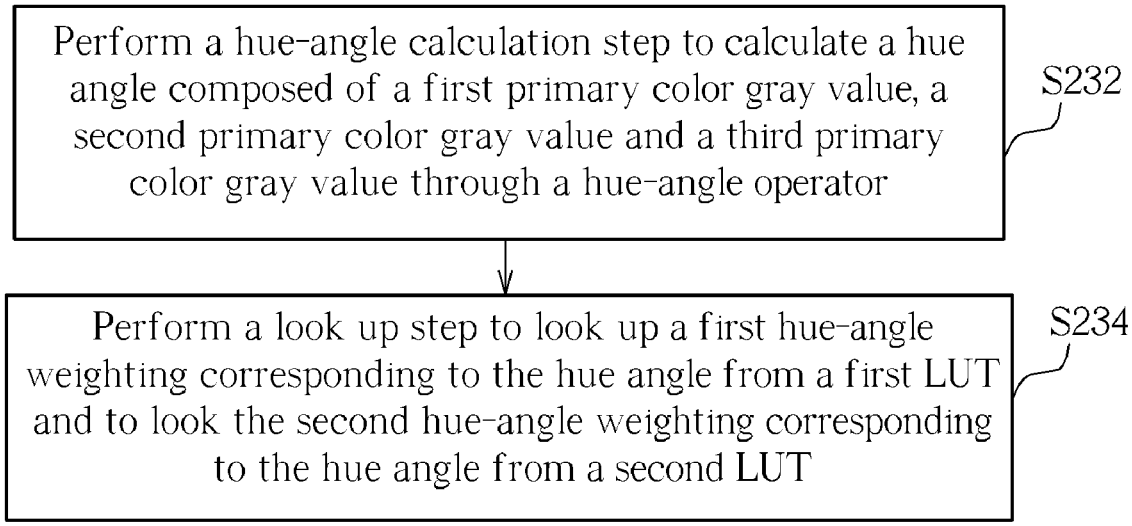
FIG. 8 is a flow chart illustrating the hue-angle weighting calculation step of the present invention.

In addition, please refer to FIG. 8, which is a flow chart illustrating the hue-angle-weighting calculation step of the present invention. As shown in FIG. 8, the hue-angle-weighting calculation step of step S230 includes the following steps:

Step S232: perform a hue-angle calculation step to calculate a hue angle composed of the first primary color gray value 146, the second primary color gray value 148 and the third primary color gray value 150 through a hue-angle calculator 142; and Step S234: perform a look up step to look up a first hue-angle weighting corresponding to the hue angle from the first LUT and to look up the second hue-angle weighting corresponding to the hue angle from the second LUT.

Please refer to FIG. 9, which is a list of the hue-angle calculation formula of the present invention. As shown by the hue angle H (×60) in FIG. 9, in step S232, the hue angle of this embodiment is calculated according to the definition of HSV space, but is not limited to this. The hue angle also can be calculated according to other color spaces. In the hue-angle calculation step, the red color gray value 146, the green color gray value 148 and the blue color gray value 150 are judged to be a maximum, a medium and a minimum. Then, the hue angle can be calculated according to a hue-angle formula H=θ+60×((the medium−the minimum)/(the maximum−the minimum)), wherein H is the hue angle. When the red gray value 146≧the green gray value 148≧the blue gray value 150, θ is zero degree. When the green gray value 148>the red gray value 146≧the blue gray value 150, θ is 60 degrees. When the green gray value 148≧the blue gray value 150>the red gray value 146, θ is 120 degrees. When the blue gray value 150>the green gray value 148>the red gray value 146, θ is 180 degrees When the blue gray value 150>the red gray value 146≧the green gray value 148, θ is 240 degrees. When the red gray value 146≧the blue gray value 150>the green gray value 148, θ is 300 degrees. The hue-angle formula of the present invention is not limited to the above-mentioned formula, and the hue angle of a color can be calculated by other hue-angle calculation formulas according to the concept that the colors in the HSV space and the hue angles have a corresponding relation.

As shown by the hue angle H (×64) in FIG. 9, in order to be conveniently used by circuit devices, the calculation ratio of the hue angles can be transformed from 60 into 64, so that the hue-angle formula can be transformed into H=θ+64×((the medium−the minimum)/(the maximum−the minimum)), and θ of 60 degrees, 120 degrees, 180 degrees, 240 degrees and 300 degrees can be respectively transformed into θ of 64 degrees, 128 degrees, 192 degrees, 256 degrees, 320 degrees so as to be easily calculated in binary digits by the circuit devices.

Figure 10:
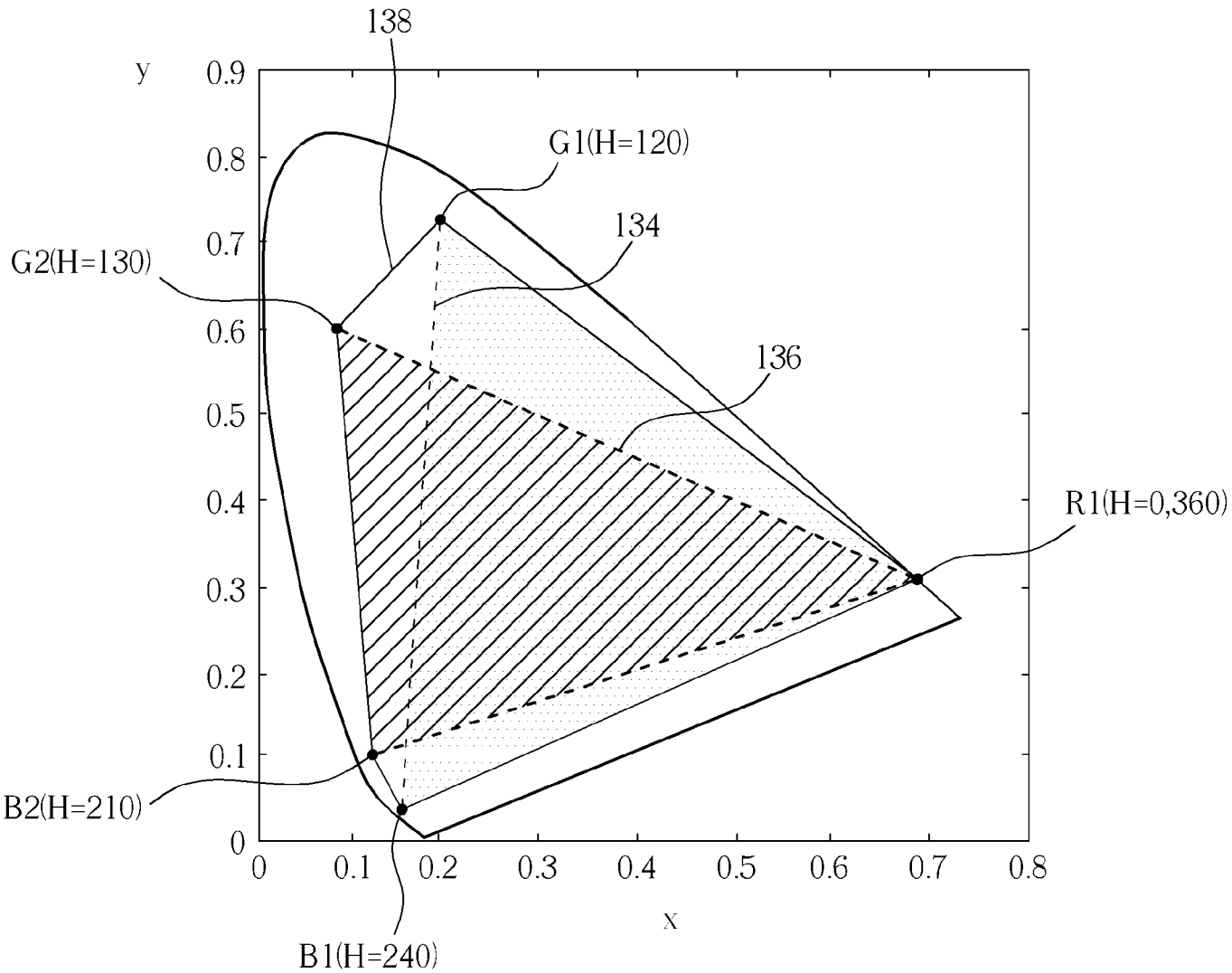
FIG. 10 is a schematic diagram illustrating the hue angles of end points of the first color gamut and end points of the second color gamut.
Figure 11:
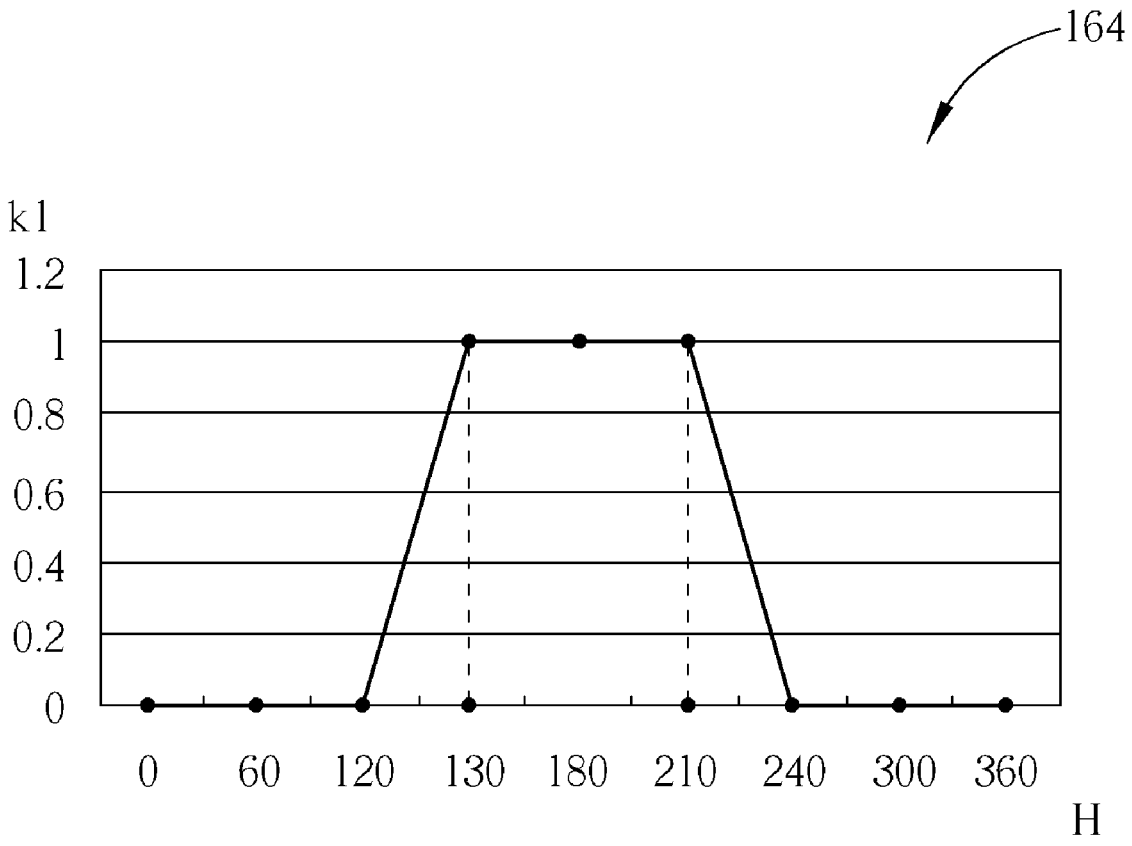
FIG. 11 is the first LUT according to the first embodiment of the present invention.
Figure 12:
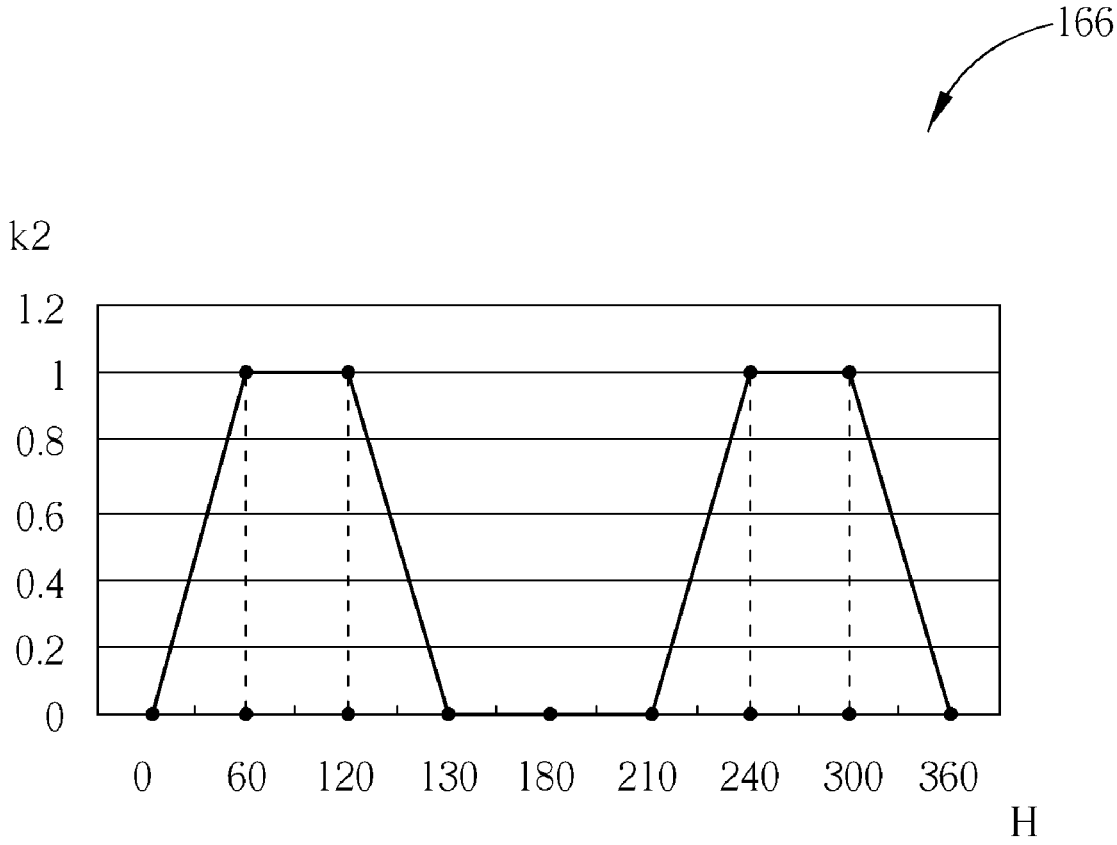
FIG. 12 is the second LUT according to the first embodiment of the present invention.

Furthermore, in step S234, the first LUT and the second LUT are calculated according to the first color gamut of the first backlight and the second color gamut of the second backlight. Please refer to FIG. 10 through FIG. 12. FIG. 10 is a schematic diagram illustrating the hue angles of end points of the first color gamut and end points of the second color gamut. FIG. 11 is the first LUT according to the first embodiment of the present invention. FIG. 12 is the second LUT according to the first embodiment of the present invention. As shown in FIG. 10, the hue angles in the end points R1, G1, B1 of the first color gamut of this embodiment are respectively 0, 120 and 240, and the hue angles in the end points R2, G2, B2 of the second color gamut are respectively 0, 130 and 210. As shown in FIG. 11 and FIG. 12, in order to have a color in the hybrid color gamut 138 by mixing the color in the first color gamut 134 with the color in the second color gamut 136, the first LUT 164 and the second LUT 166 of this embodiment can be calculated according to the hue angles of the first color gamut 134 and the second color gamut 136. The first LUT 164 represents a relation between the first hue-angle weighting and the hue angle, and the second LUT 166 represents a relation between the second hue-angle weighting and the hue angle. The first LUT 164 and the second LUT 166 of the present invention are not limited to FIG. 11 and FIG. 12.

Please refer to FIG. 6 and FIG. 7 again. In step S240, the color calculation step is performed according to a first color calculation formula $RGB_1=RGB-w\times k_1\times RGB$ and a second color calculation formula $RGB_2=RGB-w\times k_2\times RGB$, wherein $RGB_1$ is the first color output signal 114; $RGB_2$ is the second color output signal 116; RGB is the color signal 112; w is the saturation value; $k_1$ is the first hue-angle weighting; and $k_2$ is the second hue-angle weighting. In addition, in step S240, the red gray value 146, the green gray value 148 and the blue gray value 150 of the color signal 112 are respectively transformed into a first red output gray value 152, a first green output gray value 154 and a first blue output gray value 156 of the first color output signal 114 through the first color calculation formula, and are respectively transformed into a second red output gray value 158, a second green output gray value 160 and a second blue output gray value 162 of the second color output signal 116 through the second color calculation formula.

As the above-mentioned description, this embodiment calculates the saturation value and two hue-angle weightings of the color signal, and transforms the color signal into two color output signals corresponding to two backlights, so that the color gamut of the displayed color can be raised in cooperation with turning on the backlights in sequence so as to display more plentiful colors. As compared with the prior art that transforms the gray-level signal into XYZ color-space signal, the present invention can have an effect of mixing multiple primary colors only by the saturation calculator, the hue-angle calculator and color calculator in cooperation with two backlights, and avoid consuming extra calculators due to extra matrix operation. Furthermore, the present invention only requires disposing three color filters in one pixel, so that the increased complexity of circuit devices and extra costs of manufacturing extra color filters can be avoided. It should be noted that the present invention is not limited to only using two backlights, and is not limited to only calculating two color output signals. The present invention also can use a plurality of backlights in cooperation with calculating a plurality of color output signals to provide a more colorful image.

Figure 13:
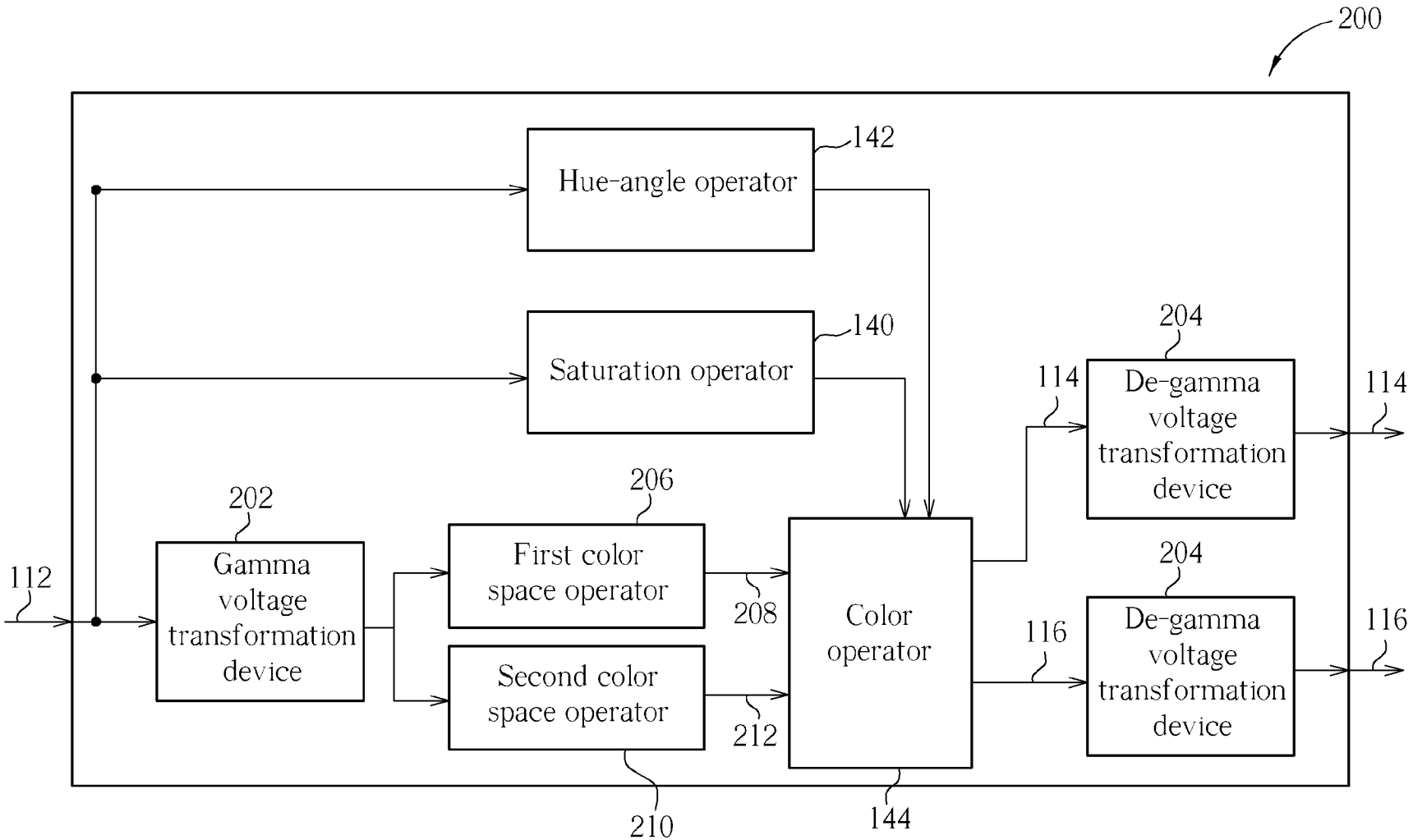
FIG. 13 is a block diagram illustrating a calculator according to a second embodiment of the present invention.
Figure 14:
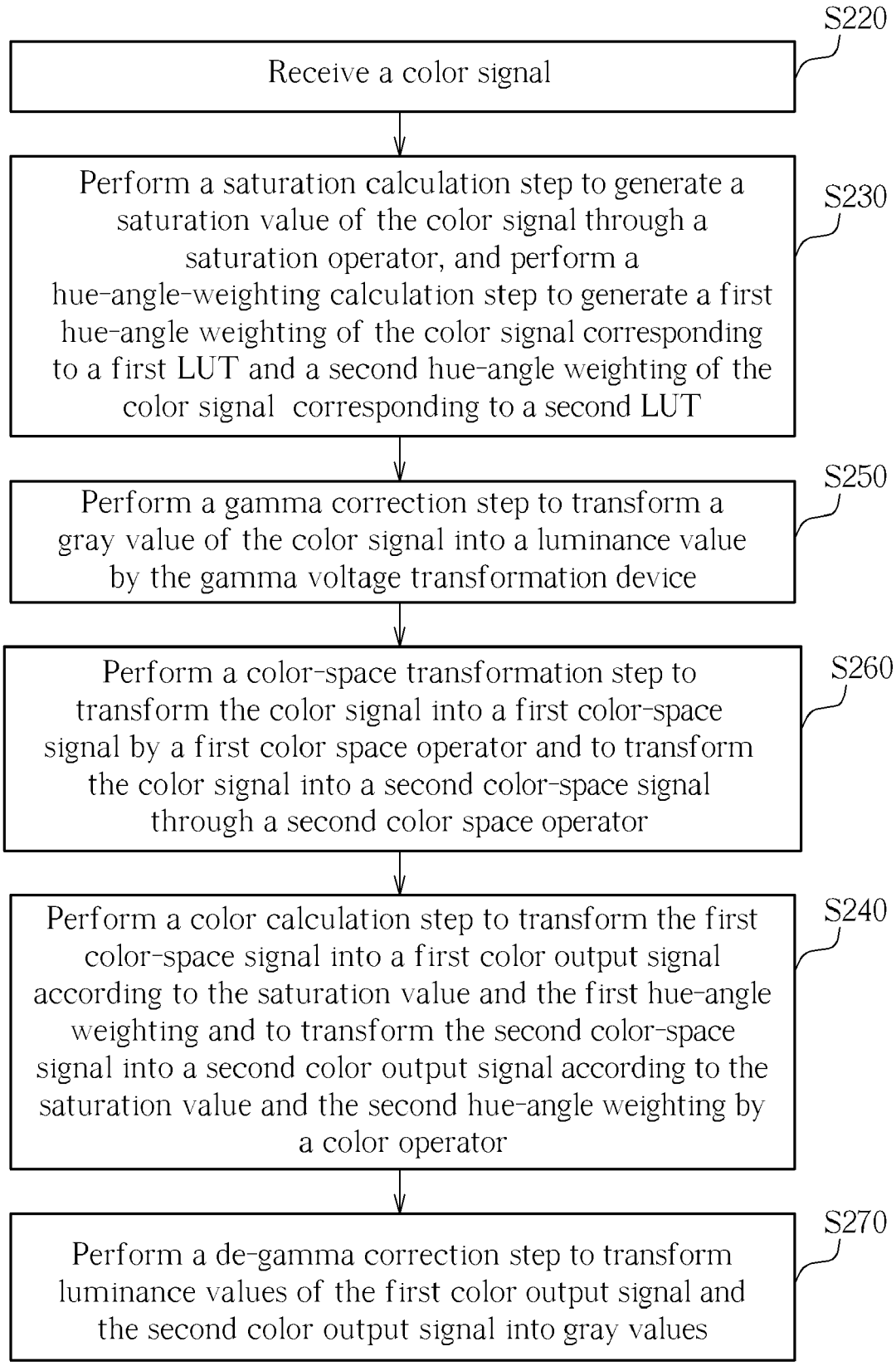
FIG. 14 is a flow chart illustrating a color transformation method according to the second embodiment of the present invention.

In addition, the color transformation method of the present invention is not limited to the above-mentioned embodiment, and also can include a gamma correction step, a de-gamma correction step or a color space transforming step. Please refer to FIG. 13 and FIG. 14. FIG. 13 is a block diagram illustrating a calculator according to a second embodiment of the present invention. FIG. 14 is a flow chart illustrating a color transformation method according to the second embodiment of the present invention. In order to clearly compare the difference between the second embodiment and the first embodiment, devices of the second embodiment which are the same as the first embodiment are denoted with the same labels. As shown in FIG. 13, as compared with the calculators of the first embodiment, a calculator 200 of this embodiment further includes a gamma voltage transformation device 202, a de-gamma voltage transformation device 204, a first color space calculator 206 and a second color space calculator 210. As shown in FIG. 14, the color transformation method of this embodiment includes the following steps:

Step S220: receive a color signal 112;

Step S230: perform a saturation calculation step to generate a saturation value of the color signal 112 through a saturation calculator 142, and perform a hue-angle-weighting calculation step to generate a first hue-angle weighting of the color signal 112 corresponding to a first LUT and a second hue-angle weighting of the color signal 112 corresponding to a second LUT;

Step S250: perform a gamma correction step to transform a gray value of the color signal 112 into a luminance value by the gamma voltage transformation device 202;

Step S260: perform a color-space transformation step to transform the color signal 112 into a first color-space signal 208 by a first color space calculator 206 and to transform the color signal 112 into a second color-space signal 212 through a second color space calculator 210;

Step S240: perform a color calculation step to transform the first color-space signal 208 into a first color output signal 114 according to the saturation value and the first hue-angle weighting and to transform the second color-space signal 212 into a second color output signal 116 according to the saturation value and the second hue-angle weighting by the color calculator 144; and Step S270: perform a de-gamma correction step to transform luminance values of the first color output signal 114 and the second color output signal 116 into gray values.

In step S250, the gamma correction step is used to avoid unfitting feeling of the human eyes for the motion image due to the obvious difference between the color displayed after calculating the color signals and the color of the image sensed by the human eyes. For this reason, the first primary color gray value, the second primary color gray value and the third primary color gray value of the inputted color signal 112 are respectively transformed into the first primary color luminance value, the second primary color luminance value and the third primary color luminance value so as to have more correct hybrid color and contribute to perform the color calculation in the following step. Furthermore, in step S260, this embodiment uses the first backlight and the second backlight to design a first color transformation matrix M1 and a second color transformation matrix M2. In the color-space transformation step, the first color space calculator 206 can multiply the first primary color luminance value, the second primary color luminance value and the third primary color luminance by the first color transformation matrix M1 to generate a first color space luminance value, a second color space luminance value and a third color space luminance value, which constitute a first color-space signal 208, and the second color space calculator 210 can multiply the first primary color luminance value, the second primary color luminance value and the third primary color luminance by the second color transformation matrix M2 to generate a fourth color space luminance value, a fifth color space luminance value and a sixth color space luminance value, which constitute a second color-space signal 212. Therefore, the first primary color luminance value, the second primary color luminance value and the third primary color luminance value can be transformed into the color space of the first backlight and the color space of the second backlight so as to avoid the color deviation while displaying the first color output signal 114 and the second color output signal 116 in the following step. In this embodiment, M1 can be $$\begin{bmatrix} 1 & 0 & 0 \\ 0 & 1 & 0 \\ 0 & 0 & 1 \end{bmatrix},$$

and M2 can b $$\begin{bmatrix} 1 & 0 & 0 \\ -0.063 & 1 & -0.038 \\ -0.120 & -0.135 & 1 \end{bmatrix}.$$

The present invention is not limited to this, and can be adjusted or designed according to the required first color gamut and the required second color gamut. Next, as compared with the first embodiment, step S240 of this embodiment uses the first color space luminance value, the second color space luminance value and the third color space luminance value to calculate the first color calculation formula $RGB_1=RGB-w\times k_1\times RGB$, and uses the fourth color space luminance value, the fifth color space luminance value and the sixth color space luminance value to calculate the second color operating formula $RGB_2=RGB-w\times k_2\times RGB$ so as to have the first color output signal 114 and the second color output signal 116 represented by the luminance values. Finally, in step S270, the de-gamma correction step transforms the luminance values of the first color output signal 114 and the second color output signal 116 that is transformed by the gamma correction step before into the gray values so as to help the display device to display.

In summary, the color transformation method of the present invention calculates the saturation value and two hue-angle weightings of the color signal, and then, performs the color calculation step corresponding to two backlights so as to generate two different color output signals. Furthermore, in cooperation with sequentially turning on the backlights, more colorful images can be displayed, and the color gamut can be raised.

Those skilled in the art will readily observe that numerous modifications and alterations of the device and method may be made while retaining the teachings of the invention.

What is claimed is:

1. A color transformation method, comprising:

receiving a color signal;

performing a saturation calculation step to generate a saturation value of the color signal through a saturation calculator, and performing a hue-angle-weighting calculation step to generate a first hue-angle weighting of the color signal corresponding to a first look-up table (LUT) and a second hue-angle weighting of the color signal corresponding to a second LUT, wherein the first LUT and the second LUT are derived from calculating a first color gamut of a first backlight and a second gamut of a second backlight; and performing a color calculation step to transform the color signal into a first color output signal according to the saturation value and the first hue-angle weighting, and to transform the color signal to a second color output signal according to the saturation value and the second hue-angle weighting by a color calculator, wherein the color calculation step is performed according to a first color calculation formula $RGB_1=RGB-w\times k_1\times RGB$ and a second color calculation formula $RGB_2=RGB-w\times k_2\times RGB$, wherein $RGB_1$ is the first color output signal, $RGB_2$ is the second color output signal, RGB is the color signal, w is the saturation value, $k_1$ is the first hue-angle weighting, and $k_2$ is the second hue-angle weighting.

2. The color transformation method of claim 1, wherein the color signal comprises a first primary color gray value, a second primary color gray value and a third primary color gray value.

3. The color transformation method of claim 2, wherein the saturation calculation step is performed according to a saturation calculation formula $w=1-min/max$, wherein w is the saturation value, min is a minimum of the first primary color gray value, the second primary color gray value and the third primary color gray value, and max is a maximum of the first primary color gray value, the second primary color gray value and the third primary color gray value.

4. The color transformation method of claim 2, wherein the hue-angle-weighting calculation step comprises:

performing a hue-angle calculation step to calculate a hue angle composed of the first primary color gray value, the second primary color gray value and the third primary color gray value through a hue-angle calculator; and performing a look up step to look up the first hue-angle weighting corresponding to the hue angle from the first LUT and to look up the second hue-angle weighting corresponding to the hue angle from the second LUT.

5. The color transformation method of claim 4, wherein the hue-angle calculation step comprises:

judging a magnitude relation between the first primary color gray value, the second primary color gray value and the third primary color gray value so as to have a maximum, a medium and a minimum; and calculating the hue angle according to a hue-angle calculation formula $H=\theta+60\times((\text{the medium}-\text{the minimum})/(\text{the maximum}-\text{the minimum}))$, wherein H is the hue angle; when the maximum is a red gray value, the medium is a green gray value, and the maximum is larger than the medium, θ is zero degree; when the maximum is the green gray value, and the medium is the red gray value, θ is 60 degrees; when the maximum is the green gray value, the medium is a blue gray value, and the maximum is larger than the medium, θ is 120 degrees; when the maximum is the blue gray value, and the medium is the green gray value, θ is 180 degrees; when the maximum is the blue gray value, and the medium is the red gray value, θ is 240 degrees; and when the maximum is the red gray value, the medium is blue gray value, and the maximum is larger or equal to the medium, θ is 300 degrees.

6. The color transformation method of claim 4, wherein the first backlight is composed of a plurality of first light-emitting units with the first color gamut, and the second backlight is composed of a plurality of second light-emitting units with the second color gamut.

7. The color transformation method of claim 6, wherein the first light-emitting units and the second light-emitting units located in a same row are arranged alternately, and the first light-emitting units and the second light-emitting units located in a same column are arranged alternately.

8. The color transformation method of claim 6, wherein each first light-emitting unit comprises a first color LED, a second color LED and a third color LED, and each second light-emitting unit comprises a fourth color LED, a fifth color LED and a sixth color LED.

9. The color transformation method of claim 1, further comprising performing a color-space transformation step after the step of receiving the color signal to transform the color signal into a first color-space signal through a first color-space calculator and to transform the color signal into a second color-space signal through a second color-space calculator.

10. The color transformation method of claim 1, further comprising performing a gamma correction step between the step of receiving the color signal and the step of performing the color calculation step to transform a gray value into a luminance value of the color signal, and performing a de-gamma correction step after the step of performing the color calculation step to transform luminance values of the first color output signal and the second color output signal into gray values.

11. A color display method, comprising:

transforming the color signal into the first color output signal and the second color output signal by a calculator according to the color transformation method of claim 1;

outputting the first color output signal and the second color output signal to a display device in sequence, wherein the display device comprises the first backlight and the second backlight;

displaying the first color output signal, and simultaneously turning on the first backlight; and displaying the second color output signal, and simultaneously turning on the second backlight.

* * * * *